US006299075B1

(12) United States Patent
Koller

(10) Patent No.: US 6,299,075 B1
(45) Date of Patent: Oct. 9, 2001

(54) SELF CLOSING FLUSH PLUG FOR POP-UP SPRINKLER

(75) Inventor: Izaak M. Koller, Encinitas, CA (US)

(73) Assignee: Hunter Industries, Inc., San Marcos, CA (US)

( * ) Notice: Subject to any disclaimer, the term of this patent is extended or adjusted under 35 U.S.C. 154(b) by 24 days.

(21) Appl. No.: 09/621,052

(22) Filed: Jul. 21, 2000

(51) Int. Cl.[7] ..... B05B 15/02; B05B 15/10

(52) U.S. Cl. ..... 239/106; 239/104; 239/201; 239/203; 239/204; 239/205; 239/506; 251/351; 251/354

(58) Field of Search ..... 239/104, 106, 239/200, 201, 202, 203, 204, 205, 206, 207, 210, 505, 506, 507, 508, 509; 251/351, 353, 354, 349

(56) References Cited

U.S. PATENT DOCUMENTS

| | | | | |
|---|---|---|---|---|
| D. 319,489 | | 8/1991 | Han et al. | D23/214 |
| 1,192,743 | * | 7/1916 | Brooks | 239/204 |
| 1,863,919 | * | 6/1932 | Brooks | 239/204 X |
| 1,865,906 | * | 7/1932 | Harford | 239/205 |
| 1,899,711 | | 2/1933 | Munz . | |
| 1,964,269 | | 6/1934 | Munz . | |
| 2,151,214 | * | 3/1939 | Kramer | 239/204 X |
| 2,514,346 | * | 7/1950 | Snoddy | 239/204 X |
| 2,546,574 | * | 3/1951 | Wilcox, Jr. | 239/204 |
| 2,975,981 | | 3/1961 | Cockman . | |
| 3,580,506 | | 5/1971 | Costa | 239/230 |
| 3,776,463 | | 12/1973 | Dyck | 239/204 |
| 3,820,717 | | 6/1974 | Pohle | 239/107 |
| 4,189,099 | * | 2/1980 | Bruninga | 239/200 |
| 4,729,511 | | 3/1988 | Citron | 239/205 |
| 4,790,481 | | 12/1988 | Ray et al. | 239/204 |
| 5,163,618 | | 11/1992 | Cordua | 239/205 |
| 5,232,156 | | 8/1993 | Csordas et al. | 239/117 |
| 6,045,059 | | 4/2000 | Weller | 239/203 |
| 6,179,221 | * | 1/2001 | Goldberg et al. | 239/106 |

* cited by examiner

*Primary Examiner*—David A. Scherbel
*Assistant Examiner*—Robin O. Evans

(57) ABSTRACT

A flush plug is provided for temporarily sealing an outlet at an upper end of an irrigation sprinkler riser extensible from an outer housing. A cap is configured to substantially cover the outlet of the riser. The cap has an output orifice dimensioned to reduce the flow of water from the riser a sufficient amount so that the riser will move to an elevated position under normal operating pressure. The cap is configured so that it can be temporarily connected to the upper end of the sprinkler riser. A shut-off flap is pivotally connected to the cap for covering and uncovering the output orifice. A lever is connected to the shut-off flap and is configured and located to engage an upper end of the sprinkler housing when the riser moves to a retracted lowered position. This positively moves the shut-off flap so that it covers the output orifice in the cap. When the riser moves to the elevated position the lever is no longer engaged with the upper end of the sprinkler housing. The shut-off flap is moved by water pressure so that it uncovers the output orifice in the cap to allow flushing of debris from the sprinkler.

21 Claims, 4 Drawing Sheets

SELF CLOSING FLUSH PLUG FOR POP-UP SPRINKLER

BACKGROUND OF THE INVENTION

The present invention relates to irrigation, and more particularly, to devices for allowing sprinklers to be flushed of debris during their installation.

Residential and commercial irrigation systems typically comprise a series of underground branch lines which are coupled to solenoid actuated diaphragm valves activated by an electronic controller. Sprinklers are connected to the branch lines at regular intervals. In many cases, so-called spray type sprinklers are installed that have a pop-up riser, and a spray nozzle or head with a fixed sector size is screwed over a male threaded outlet at the upper end of the riser.

When a residential or commercial irrigation system is installed, trenches are typically dug into which the branch lines are laid. The branch lines usually consist of a series of horizontal PVC pipe segments coupled with T-shaped connectors that allow sprinklers to be coupled thereto at regular intervals. Sometimes swing arm connectors are used to ensure that tops of the sprinklers end up at the proper grade or level. During this installation process, the sprinkler nozzles can be damaged and therefore they are usually not screwed onto the sprinklers until backfilling of the dirt is completed. Spray type sprinklers are particularly susceptible to fouling by dirt and debris due to the relatively small dimensions of their nozzle openings, e.g. 0.015 inches. In the absence of a nozzle, if the outlet of the sprinkler were left uncovered, backfilled dirt and debris would enter the sprinkler. To avoid this from happening, removable plugs or caps have been developed which temporarily seal the outlet of the sprinkler during installation. These plugs or caps can be readily removed to allow a nozzle to be installed.

Even when plugs or caps are used to seal the outlets of the sprinklers, dirt and debris can still enter the pipes of the system anywhere they are open during the assembly process. Therefore, it is customary to flush the system of all dirt and debris prior to the installation of the nozzles. Where plugs or caps are removed to facilitate flushing, dirt, mud and other debris sometimes re-enter the pipes after flushing and before the nozzles can be installed.

Special flush plugs have therefore been developed for use during sprinkler installation to facilitate flushing without the removal thereof U.S. Pat. No. 5,163,618 of Cordua discloses a flush plug commercialized by HIT that is screwed into the upper end of the riser and uses a vertically reciprocable horizontal sealing plate that selectively seals the entire riser outlet before and after flushing. U.S. Pat. No. 6,045,059 of Weller assigned to the Toro Company discloses a flush plug with a vertical leg that inserts and locks into the upper end of the riser and also relies upon a horizontal circular disc shaped cover to selectively seal the entire riser outlet before and after flushing. Each of the foregoing patented flush plugs disadvantageously relies upon the proper mating of a circular disk like element of the flush plug with the entire circumference of the upper end of the sprinkler riser that defines the outlet.

U.S. Pat. No. Des. 319,489 of Han et al. assigned to Anthony Manufacturing Corporation shows a design for a sprinkler flush plug that is widely commercialized under the RAIN BIRD trademark. It has a gate formed as a three-sided rectangular cut-out region in a top horizontal wall of the plug. This gate deflects to allow water and debris to be flushed out of the sprinkler. However, there is a substantial gap between the gate and the remainder of the wall in which it is formed which can allow dirt and other debris into the sprinkler. In addition the water flushed out of the sprinkler through the deflecting gate of this plug flows more or less around the sprinkler back into the excavation area.

SUMMARY OF THE INVENTION

It is therefore the primary object of the present invention to provide an improved flush plug for a pop-up sprinkler.

Accordingly, the present invention provides a flush plug for temporarily sealing an outlet at an upper end of a sprinkler riser extensible from an outer housing. A cap is configured to substantially cover the outlet of the riser. The cap has an output orifice dimensioned to reduce the flow of water from the riser a sufficient amount so that the riser will move to an elevated position under normal operating pressure. The cap is configured so that it can be temporarily connected to the upper end of the sprinkler riser. A shut-off flap is pivotally connected to the cap for covering and uncovering the output orifice. A lever is connected to the shut-off flap and is configured and located to engage an upper end of the sprinkler housing when the riser moves to a retracted lowered position. This positively moves the shut-off flap so that it covers the output orifice in the cap. When the riser moves to the elevated position the lever is no longer engaged with the upper end of the sprinkler housing. The shut-off flap is moved by water pressure so that it uncovers the output orifice in the cap to allow flushing of debris from the sprinkler.

The present invention also provides a novel method of installing a pop-up sprinkler. The first step of the method involves temporarily connecting a flush plug over the outlet of a riser of a pop-up sprinkler, the flush plug having a shut-off flap that is held over and seals an output orifice of the flush plug when the riser is in a lowered retracted position. The second step of the method involves pressurizing the sprinkler with water to cause the riser to extend to an elevated position to move the shut-off flap away from the output orifice by water pressure to unseal the output orifice and to allow debris to be flushed out of the sprinkler through the output orifice. The third step of the method involves de-pressuring the sprinkler to cause the riser to move to its lowered retracted position and the shut-off flap to once again cover and seal the output orifice. The fourth and final step of the method involves replacing the flush plug with a nozzle.

DESCRIPTION OF THE PREFERRED EMBODIMENTS

Figure 1:
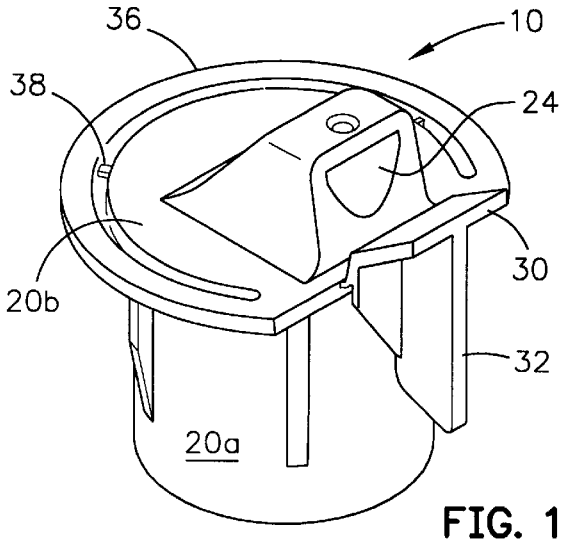
FIG. 1 is an enlarged perspective view of a preferred embodiment of the flush plug of the present invention.
Figure 6:
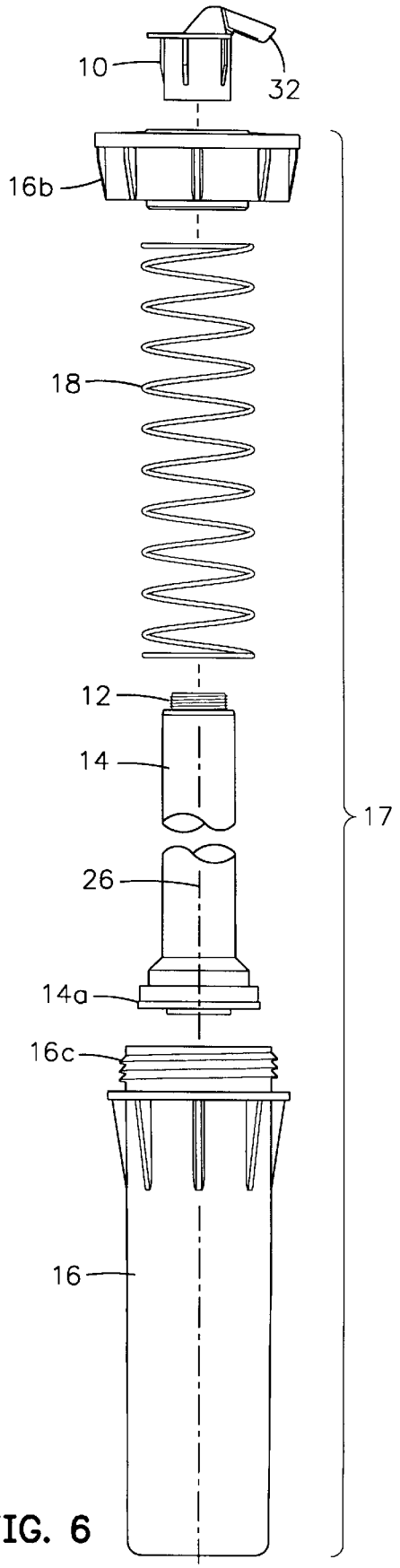
FIG. 6 is a slightly reduced exploded side elevation view of the sprinkler of FIG. 2.

FIG. 1 illustrates a flush plug 10 for temporarily sealing a relatively large circular horizontally disposed outlet 12 (FIG. 6) at an upper end of a tubular sprinkler riser 14 extensible from an outer cylindrical housing 16 of a spray type sprinkler 17. The lower end of the housing 16 has a female threaded inlet 16*a* (FIG. 2) which is screwed over the male threaded portion of a T-shaped connector (not illustrated) forming part of the one the branch lines of an underground sprinkler system used in residential or commercial irrigation. A riser retraction coil spring 18 (FIGS. 2 and 6) surrounds the riser 14 and is positioned between a lower enlarged portion or flange 14*a*(FIG. 6) of the riser 14 and a cylindrical retainer 16*b* forming the upper end of the sprinkler housing 16. The retainer 16*b* has a female threaded portion that screws over the upper male threaded portion 16*c* of the housing. Normally a spray nozzle (not illustrated) is screwed over the male threads of the outlet 12 at the upper end of the riser 14.

Figure 3:
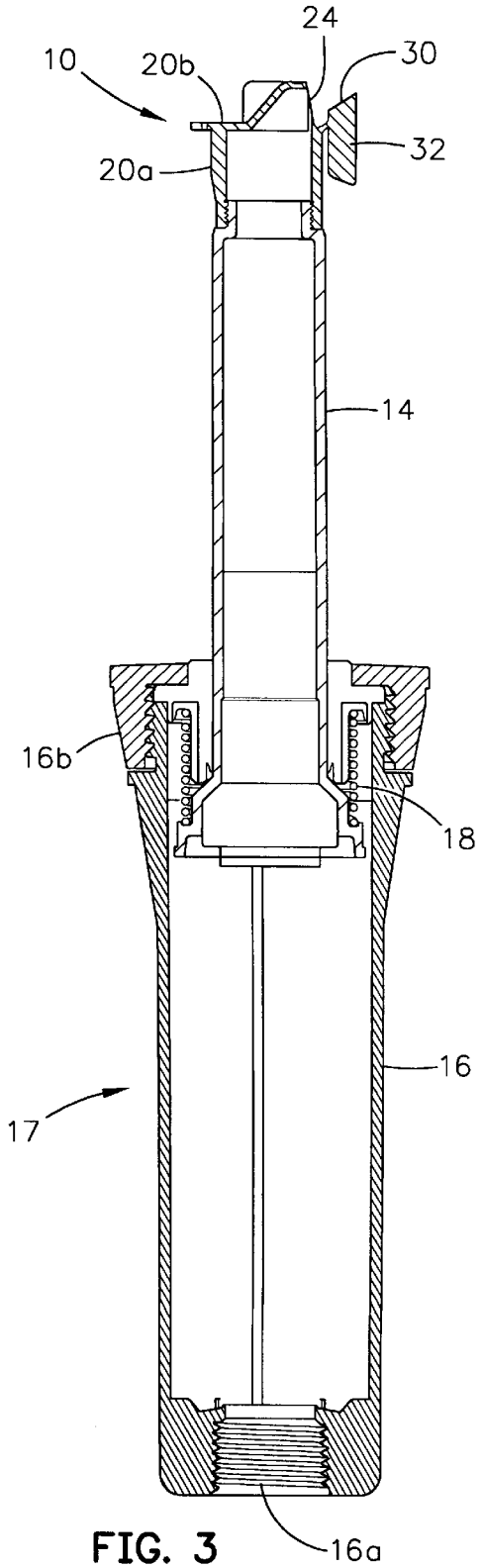
FIG. 3 is a vertical section view similar to FIG. 2 with the riser shown in its elevated position.
Figure 4:
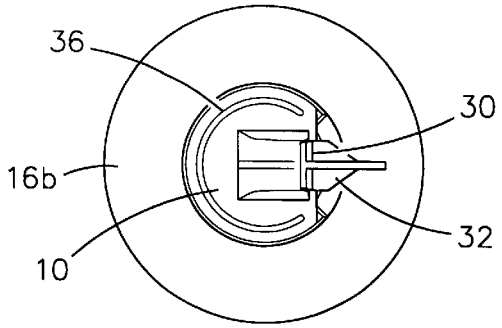
FIG. 4 is a top plan view of the sprinkler of FIG. 2.
Figure 5:
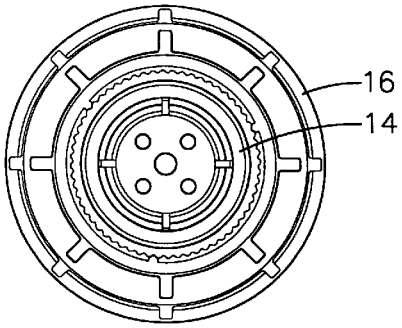
FIG. 5 is a horizontal sectional view of the sprinkler taken along line 5—5 of FIG. 2.

The spray nozzle used that may be installed in the sprinkler 17 may either have a fixed arc, or it may have a variable arc, such as the spray nozzle disclosed in U.S. Pat. No. 4,579,285 of Hunter, the entire disclosure of which is hereby incorporated by reference. When pressurized water, which is supplied to the housing 16 through the inlet 16*a*, is turned ON, back pressure within the sprinkler 17 causes the riser 14 to extend upwardly from the housing 16 in telescoping fashion as illustrated in FIG. 3. A spray of water having a predetermined arc size is sprayed over the adjacent turf and/or vegetation. When the pressurized water is turned OFF, the force of the previously compressed coil spring 18 retracts the riser 14 so that the upper end of the nozzle is level with the upper end of the retainer 16*b*.

Figure 7:
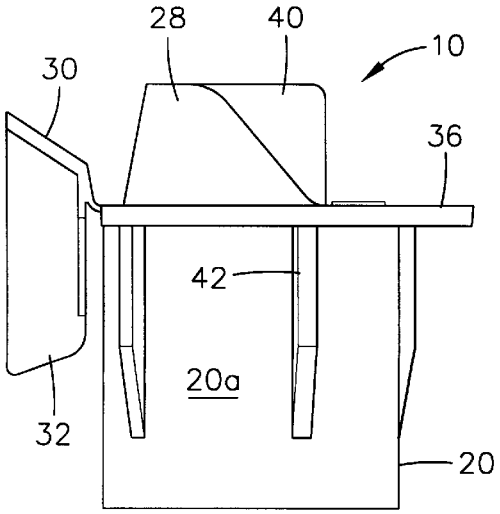
FIG. 7 is an enlarged side elevation view of the preferred embodiment of the flush plug of the present invention.
Figure 11:
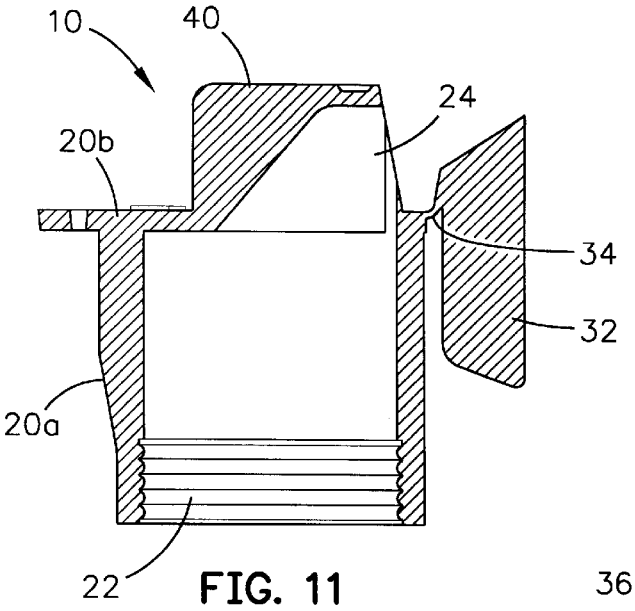
FIG. 11 is a vertical section view of the flush plug taken along line 11—11 of FIG. 8.
Figure 12:
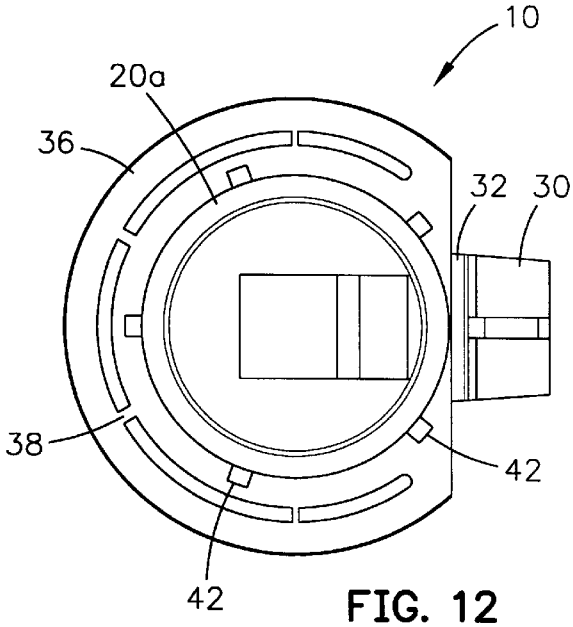
FIG. 12 is an bottom plan view of the preferred embodiment of the flush plug of the present invention.
Figure 13:
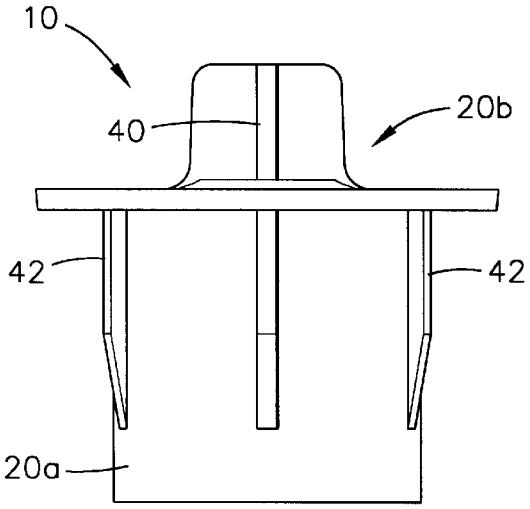
FIG. 13 is side elevation view of the flush plug similar to FIG. 8 except that the flush plug has been rotated one hundred and eighty degrees about its vertical axis.

The flush plug 10 includes a cap 20 (FIG. 7) with a lower cylindrical portion 20*a* that is configured to mate with and cover the outlet 12 at the upper end of the riser 14. The cylindrical portion 20*a* of the cap 20 includes means for temporarily connecting the cap 20 to the upper end of the sprinkler riser 14 in the form of a series of spaced apart parallel ribs 22 (FIG. 11) in the cylindrical portion 20*a*. The ribs 22 are sized so that they act like female threads and screw over the standard male threads on the outlet 12 of the riser 14. Other connection means could be used such as standard male and female threads, bayonet locking lugs or other forms of mating recesses and projections, so long as the cap 20 is secured sufficiently so that it will not blow off the upper end of the riser 14 when subjected to normal water pressure. The cap 20 has an upper manifold portion 20*b* that extends across the cylindrical portion 20*a* and defines a V-shaped output orifice 24 (FIG. 1). The output orifice 24 is dimensioned to reduce the flow of water from the riser 14 a sufficient amount so that the riser 14 will move to its elevated position illustrated in FIG. 3 under normal operating pressure. The manifold portion 20*b* is configured so that water ejected from the output orifice 24 flows in a stream directed generally transverse to the vertical axis 26 (FIG. 6) of the sprinkler 17. The manifold portion 20*b* has a tapered hood or scoop-like configuration shaped to provide an angled deflecting wall 28 (FIG. 7) for directing water in a lateral direction through the output orifice 24. This ejects the water away from the excavation area.

A shut-off flap 30 (FIGS. 1, 7 and 9) is pivotally connected to the cap 20 for covering and uncovering the output orifice 24. A lever 32 is connected to the shut-off flap 30 and is configured to engage the retainer ring 16*b* at the upper end of the sprinkler housing 16 when the riser 14 moves to a retracted lowered position illustrated in FIG. 2. This positively moves the shut-off flap 30 so that it covers the output orifice 24 in the cap 20. The force of the riser retraction spring 18 holds the shut-off flap 30 firmly against the angled flat face of the manifold portion 20*b* that defines the V-shaped output orifice 24, thereby providing a tight seal that prevents the entry of any dirt or debris. When the riser 14 moves to its elevated position illustrated in FIG. 3 the lever 32 is no longer engaged with a the retainer ring 16*b* at the upper end of the sprinkler housing 16. The shut-off flap 30 is moved by water pressure so that it uncovers the output orifice 24 in the cap 20 to allow flushing of debris from the sprinkler 17. The shut-off flap could also be designed to slide longitudinally or pivot about an axis perpendicular to its plane in which case other means for positively moving the shut-off flap between its open and closed positions besides the lever 32 would need to be used, such as cams, cooperating shoulders, arms and other projections as would be apparent to those skilled in the art.

Figure 9:
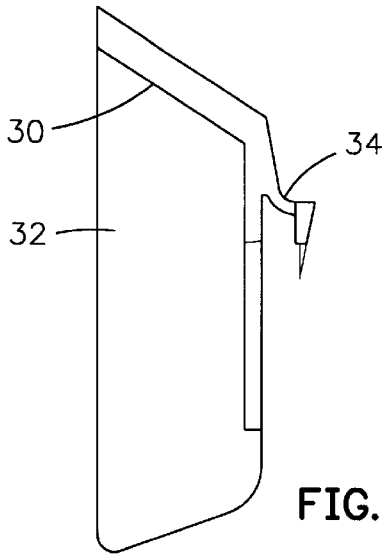
FIG. 9 is a further enlarged side elevation view of the shut-off flap of the flush plug of FIGS. 1, 7 and 8.

The shut-off flap 30 and the cap 20 are preferably integrally molded out of a thermoplastic material and are connected by a living hinge 34 (FIG. 9). Suitable thermoplastic materials include polyethylene, polypropylene and a mixture of polyethylene and polypropylene. The material should have the flexibility and durability necessary to function as the living hinge 34. The shut-off flap 30 and the lever 32 are connected in a T-shaped configuration to provide additional strength and rigidity to the shut-off flap 30.

Figure 8:
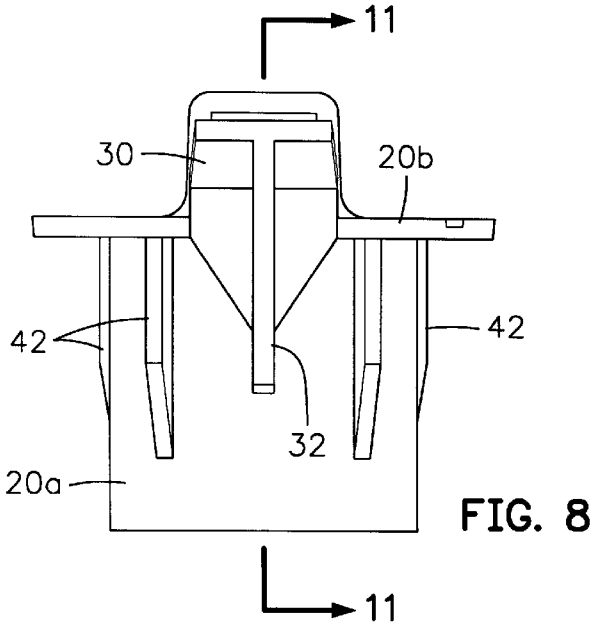
FIG. 8 is a side elevation view of the flush plug similar to FIG. 7 except that the flush plug has been rotated ninety degrees about its vertical axis.
Figure 10:
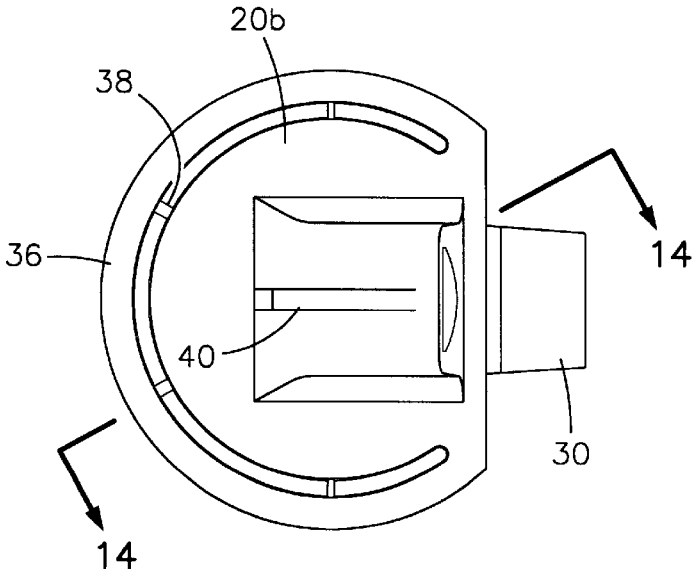
FIG. 10 is an enlarged top plan view of the preferred embodiment of the flush plug of the present invention.
Figure 14:
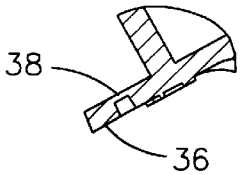
FIG. 14 is a further enlarged fragmentary sectional view taken along line 14—14 of FIG. 10 illustrating details of the manner in which the finger ring of the flush plug is connected to the cap.

A finger ring 36 (FIGS. 1 and 10) is connected to the periphery of the cap 20 for manually pulling the riser 14 to its elevated position when the water pressure is turned OFF so that the flush plug 10 can be removed and replaced with a suitable spray nozzle. The finger ring 36 comprises an arcuate segment of plastic spaced radially outwardly from the manifold portion 20*b* of the cap 20. The terminal ends of this arcuate segment extend integrally from the manifold portion 20*b* while the arcuate segment is joined by tiny bridges 38 (FIGS. 1 and 14). The installer can pull upwardly on the arcuate segment of the finger ring 36, bending it to a vertical orientation and breaking the bridges 38. This allows his or her index finger to be inserted inside the arcuate segment to pull the riser 14 upwardly. A fin 40 (FIG. 7) extends vertically from the rear side of the manifold portion 20*a*. This fin 40 is a result of the way the mold tools have been designed. It is preferable to eliminate the fin 40 to increase the clearance for the installer's index finger to fit inside the finger ring 36. Circumferentially spaced ribs 42 (FIG. 8) are molded to the cylindrical portion 20*a* of the cap 20 and connect it to the projecting horizontal peripheral flange of the manifold portion 20*b*.

Figure 2:
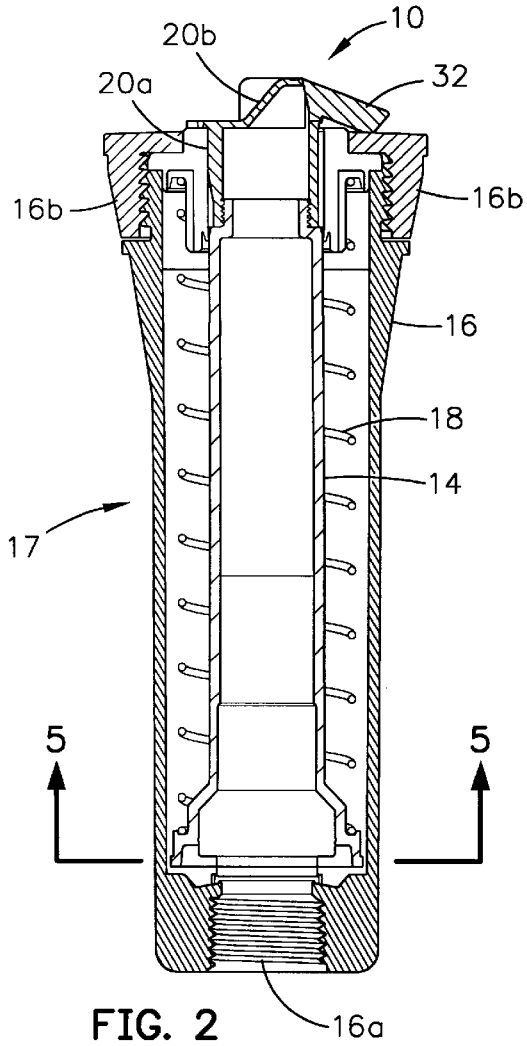
FIG. 2 is a vertical sectional view of a pop-up sprinkler with the flush plug of FIG. 1 installed therein and with its riser shown in its retracted lowered position.

The present invention also provides a novel method of installing a pop-up sprinkler 17. The first step of the method involves temporarily connecting a flush plug 10 over the outlet 12 of a riser 14 of the pop-up sprinkler 17, the flush plug 10 having a shut-off flap 30 that is held over and seals an output orifice 24 of the flush plug 10 when the riser 14 is in a lowered retracted position (FIG. 2). The second step of the method involves pressurizing the sprinkler 17 with water to cause the riser 14 to extend to an elevated position (FIG. 3) to move the shut-off flap 30 away from the output orifice 24 by water pressure to unseal the output orifice 24 and to allow debris to be flushed out of the sprinkler 17 through the output orifice 24. The third step of the method involves de-pressuring the sprinkler 17 to cause the riser 14 to move to its lowered retracted position and the shut-off flap 30 to once again cover and seal the output orifice 24. The fourth and final step of the method involves replacing the flush plug 10 with a conventional spray nozzle (not illustrated).

While I have described a preferred embodiment of my flush plug for use with irrigation sprinklers, and a novel method of installing and flushing a pop-up sprinkler, it will be understood by those skilled in the art that my invention can be modified in both arrangement and detail. Therefore, the protection afforded my invention should only be limited in accordance with the following claims.

I claim:

1. A flush plug for temporarily sealing an outlet at an upper end of a sprinkler riser extensible from an outer housing, comprising:

a cap configured to substantially cover the outlet of the riser and having an output orifice dimensioned to reduce the flow of water from the riser a sufficient amount so that the riser will move to an elevated position under normal operating pressure;

means for temporarily connecting the cap to the upper end of the riser;

a shut-off flap integrally molded with the cap and pivotally connected to the cap by a living hinge for covering and uncovering the output orifice; and a lever connected to the shut-off flap, the lever being configured and located to engage an upper end of the sprinkler housing when the riser moves to a retracted lowered position in order to positively move the shut-off flap to cover the output orifice in the cap, whereby the shut-off flap is moved by water pressure to uncover the output orifice in the cap to flush debris from the sprinkler when the riser moves to the elevated position and the lever is no longer engaged with the upper end of the sprinkler housing.

2. The flush plug of claim 1 wherein the cap has a lower cylindrical portion that mates with the upper end of the riser.

3. The flush plug of claim 2 wherein the means for temporarily connecting the cap to the upper end of the riser includes female threads in the cylindrical portion of the cap.

4. The flush plug of claim 2 wherein the cap has an upper manifold portion that extends across the cylindrical portion and defines the output orifice.

5. The flush plug of claim 4 wherein the manifold portion is configured so that water ejected from the output orifice flows in a stream directed generally transverse to the vertical axis of the sprinkler.

6. The flush plug of claim 4 wherein the manifold portion is shaped to provide a deflecting wall for directing water in a lateral direction through the output orifice.

7. The flush plug of claim 1 and further comprising a finger ring connected to the cap for manually pulling the riser to the elevated position.

8. The flush plug of claim 1 wherein the shut-off flap and the lever are connected in a T-shaped configuration.

9. The flush plug of claim 4 wherein the upper manifold portion has a tapered hood that defines the output orifice.

10. A temporarily sealed pop-up sprinkler, comprising:

a cylindrical housing having an inlet at its lower end;

a tubular riser mounted in the cylindrical housing, the riser having an outlet at an upper end of the riser, the riser being extensible from the housing between a retracted lowered position and an elevated position;

a spring surrounding the riser and mounted in the housing for biasing the riser to the retracted lowered position;

a cap configured to substantially cover the outlet of the riser and having an output orifice;

means for temporarily connecting the cap to the upper end of the riser;

a finger ring connected to the cap for manually pulling the riser to the elevated position;

a shut-off flap connected to the cap for covering and uncovering the output orifice; and means connected to the shut-off flap for engaging an upper end of the sprinkler housing when the riser moves to a retracted lowered position in order to move the shut-off flap to cover the output orifice in the cap.

11. A temporarily sealed pop-up sprinkler, comprising:

a cylindrical housing having an inlet at its lower end;

a tubular riser mounted in the cylindrical housing, the riser having an outlet at an upper end of the riser, the riser being extensible from the housing between a retracted lowered position and an elevated position;

a spring surrounding the riser and mounted in the housing for biasing the riser to the retracted lowered position;

a cap configured to substantially cover the outlet of the riser and having an output orifice formed in a planar surface;

means for temporarily connecting the cap to the upper end of the riser;

a planar shut-off flap connected to the cap for mating with the planar surface of the cap to seal and unseal the output orifice; and means connected to the shut-off flap for engaging an upper end of the sprinkler housing when the riser moves to a retracted lowered position in order to move the shut-off flap to seal the output orifice in the cap.

12. The sprinkler of claim 11 wherein the cap has a lower cylindrical portion that mates with the upper end of the riser.

13. The sprinkler of claim 12 wherein the means for temporarily connecting the cap to the upper end of the riser includes female threads in the cylindrical portion of the cap.

14. The sprinkler of claim 12 wherein the cap has an upper manifold portion that extends across the cylindrical portion and defines the output orifice.

15. The sprinkler of claim 14 wherein the manifold portion is configured so that water ejected from the output orifice flows in a stream directed generally transverse to the vertical axis of the sprinkler.

16. The sprinkler of claim 14 wherein the manifold portion is shaped to provide a deflecting wall for directing water in a lateral direction through the output orifice.

17. The sprinkler of claim 11 wherein the shut-off flap and the cap are integrally molded out of a thermoplastic material and are connected by a living hinge.

18. The sprinkler of claim 11 and further comprising a finger ring connected to the cap for manually pulling the riser to the elevated position.

19. The sprinkler of claim 11 wherein the orifice has a V-shaped configuration.

20. A method of installing a sprinkler, comprising:

temporarily connecting a flush plug over the outlet of a riser of a pop-up sprinkler, the flush plug having a shut-off flap that is positively held over and completely seals an output orifice of the flush plug when the riser is in a lowered retracted position by a lever connected to the shut-off flap engaging an outer housing of the pop-up sprinkler;

pressurizing the sprinkler with water to cause the riser to extend to an elevated position to disengage the lever with the outer housing of the pop-up sprinkler to allow the shut-off flap to move away from the output orifice by water pressure to unseal the output orifice and allow debris to be flushed out of the sprinkler through the output orifice;

de-pressuring the sprinkler to cause the riser to move to its lowered retracted position and cause the lever to re-engage the outer housing of the pop-up sprinkler to positively move the shut-off flap to once again cover and completely seal the output orifice; and replacing the flush plug with a nozzle.

21. A flush plug for temporarily sealing an outlet at an upper end of a sprinkler riser extensible from an outer housing, comprising:

a cap configured to substantially cover the outlet of the riser and having an output orifice dimensioned to reduce the flow of water from the riser a sufficient amount so that the riser will move to an elevated position under normal operating pressure;

means for temporarily connecting the cap to the upper end of the riser;

a finger ring connected to the cap for manually pulling the riser to the elevated position;

a shut-off flap pivotally connected to the cap for covering and uncovering the output orifice; and a lever connected to the shut-off flap, the lever being configured and located to engage an upper end of the sprinkler housing when the riser moves to a retracted lowered position in order to positively move the shut-off flap to cover the output orifice in the cap, whereby the shut-off flap is moved by water pressure to uncover the output orifice in the cap to flush debris from the sprinkler when the riser moves to the elevated position and the lever is no longer engaged with the upper end of the sprinkler housing.

* * * * *

UNITED STATES PATENT AND TRADEMARK OFFICE

CERTIFICATE OF CORRECTION

PATENT NO. : 6,299,075 B1
DATED : October 9, 2001
INVENTOR(S) : Izaak M. Koller

It is certified that error appears in the above-identified patent and that said Letters Patent is hereby corrected as shown below:

Column 2,
Before the heading "ABSTRACT" insert the line
-- *Attorney, Agent or Firm* - Michael H. Jester --.

Signed and Sealed this

Twenty-sixth Day of March, 2002

*Attest:*

*Attesting Officer*

JAMES E. ROGAN
*Director of the United States Patent and Trademark Office*